United States Patent [19]

Sundberg et al.

[11] Patent Number: 4,711,179

[45] Date of Patent: Dec. 8, 1987

[54] ARRANGEMENT IN A MINE WHICH IS CAPABLE OF BEING NEUTRALIZED

[75] Inventors: Sten Sundberg; Stig Risberg, both of Eskilstuna; Ulf Eriksson, Ödeshög, all of Sweden

[73] Assignee: Affärsverket FFV, Eskilstuna, Sweden

[21] Appl. No.: 916,970

[22] PCT Filed: Nov. 27, 1985

[86] PCT No.: PCT/SE85/00489

§ 371 Date: Oct. 17, 1986

§ 102(e) Date: Oct. 17, 1986

[87] PCT Pub. No.: WO86/03827

PCT Pub. Date: Jul. 3, 1986

[51] Int. Cl.[4] ..... F42B 23/24

[52] U.S. Cl. ..... 102/426; 102/401; 102/404

[58] Field of Search ..... 102/401, 404, 426

[56] References Cited

FOREIGN PATENT DOCUMENTS 0022099 1/1981 European Pat. Off. ..... 102/426
3127522 1/1983 Fed. Rep. of Germany ..... 102/401
3151674 7/1983 Fed. Rep. of Germany ..... 102/426
2551198 3/1985 France ..... 102/426

*Primary Examiner*—Deborah L. Kyle
*Assistant Examiner*—Michael J. Carone
*Attorney, Agent, or Firm*—Fleit, Jacobson, Cohn & Price

[57] ABSTRACT

An arrangement in a mine which is capable of being neutralized, comprising detecting means (33) operative to detect a neutralization of the mine, and initiator means (3) adapted to initiate detonation of a spotter charge (5) incorporated in the mine in response to the detection of a neutralization, and a spotter (1) which is arranged to be propelled from the mine by said detonator charge to the surface of the ground, in order to disclose the location of the mine. A penetrator (4), which is intended to drive a pathway through the ground to facilitate passage of the spotter (1), is arranged forwardly of the spotter in the mine, as seen in its direction of travel. The spotter (1) is capable of forwardly driving the penetrator (4) during a first phase of the spotter firing sequence; and the arrangement further includes a separating device (9) which is intended to separate the spotter from the penetrator during a second phase of the firing sequence.

4 Claims, 5 Drawing Figures

ARRANGEMENT IN A MINE WHICH IS CAPABLE OF BEING NEUTRALIZED

TECHNICAL FIELD

The present invention relates to an arrangement in a mine which is capable of being disarmed or "neutralized" and which can be buried in the ground and which incorporate detecting means effective to detect a neutralized mine, and an initiating device which in response to the detection of a neutralization initiates the detonation of a marker firing charge or "spotter" charge arranged in the mine and capable of propelling a spotter device in the mine to the surface of the ground in which the mine is buried, therewith to indicate the location of the neutralized mine.

BACKGROUND PRIOR ART

Such an arrangement is known to the art from, for example, Swedish Patent Specification SE No. 7905478-9. This earlier Patent Specification describes and illustrates an anti-tank mine which incorporates an initiator for initiating detonation of the mine, and a timing circuit which subsequent to a given time delay from the time of arming the mine, for example a time delay of 30–40 days, neutralizes the mine, if the mine has not been detonated prior thereto. The mine incorporates a spotter charge which is detonated in response to the act of neutralizing the mine and fires a spotter to the surface of the ground in which the mine is buried, therewith to indicate the location of the neutralized mine, the spotter being connected to the mine by means of a connecting line. The mine can then be dug from the ground and reactivated.

It is difficult, however, to dimension satisfactorily the force at which the spotter is propelled. For example, if this force is dimensioned so as also to resist hard earth layers, so that the spotter is reliably driven to the surface of the ground, the speed at which the spotter moves may be excessively high in the case of lightly of loosely packed earth layers, such as to cause the connecting line to break and the spotter to disappear, thereby making it difficult to locate the mine. If, on the other hand the mine is dimensioned for a lighter driving force, the speed at which the spotter is propelled through the ground may be too low, for example in the case of hard earth layers, for the spotter to penetrate to ground level.

DISCLOSURE OF THE INVENTION

Consequently, the object of the invention is to provide an arrangement of the aforesaid kind which will ensure that when fired the spotter will always reach the surface of the ground in which the mine is buried, without being propelled at a speed which might cause the spotter to disappear from the site at which the mine is buried.

This object is achieved with the aid of an arrangement according to the invention having the characterizing features set forth in the preamble to claim 1.

Further developments of the invention are set forth in the depending claims.

BRIEF DESCRIPTION OF THE DRAWINGS

The invention will now be described in more detail with reference to a preferred embodiment thereof illustrated in the accompanying drawings.

DESCRIPTION OF A PREFERRED EMBODIMENT

Figure 1:
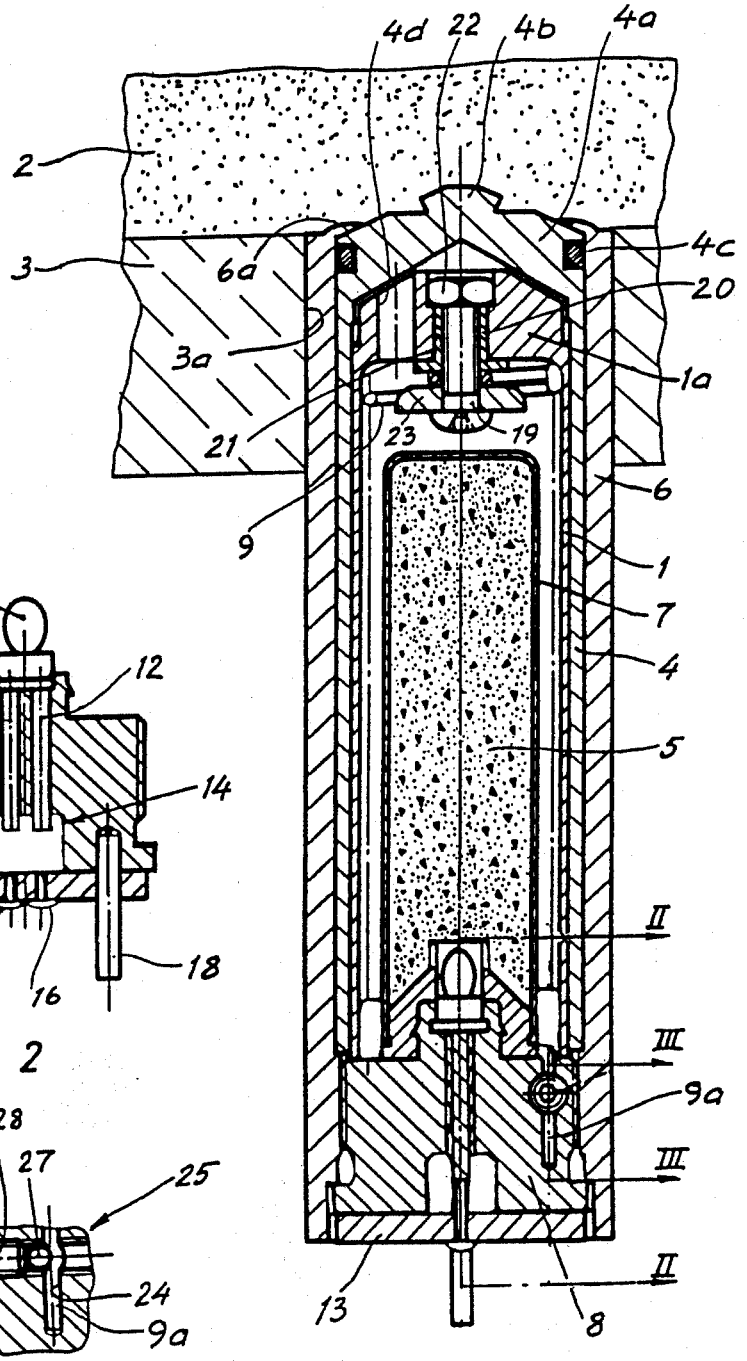
FIG. 1 is a longitudinal sectional view of the arrangement according to the invention.
Figure 4:
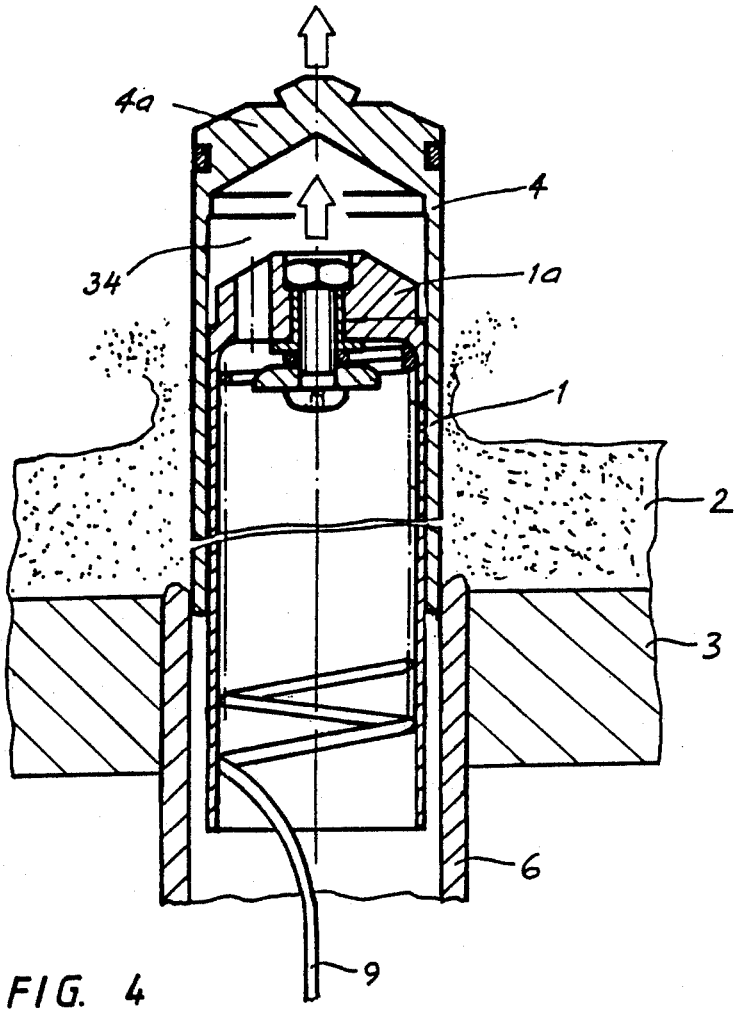
FIG. 4 illustrates the spotter during a firing sequence.

The arrangement according to the invention includes in general a spotter which in the illustrated embodiment comprises a spotter sleeve 1, which in FIG. 1 is shown in an inactive position in a mine buried in the ground 2 (in FIG. 1 the cover plate of the mine is illustrated schematically at 3), and which in FIG. 4 is shown during a firing sequence, accompanied by a penetrator 4. The arrangement further includes a spotter charge 5 which fires the spotter sleeve 1 from the mine, in response to a neutralization of the mine. When fired, the spotter sleeve 1 travels through an outer sleeve 6 rigidly connected to the mine and, in the manner of a sabot, drives the forwardly located penetrator 4 out of the outer sleeve 6, through the ground 2 and up into the air.

The components forming part of the arrangement according to the invention are described in detail hereinafter.

The outer sleeve 6 is rigidly connected to the mine by means of some suitable fastener device, for example a screw or bolt joint, and comprises a cylindrical sleeve which is open at both ends and which is suitably made of high-tensile steel. The sleeve is mounted vertically in the mine, with the upper end of the sleeve opening through an aperture **3*a* in the cover plate 3 of the mine. The sleeve edge defining the upper open-end thereof is folded inwardly to form a folded edge 6*a*, which abuts the forward end of the penetrator 4**.

The penetrator 4 comprises a cylindrical sleeve, made suitably of stainless steel, which is arranged co-axially with and within the outer sleeve 6 and which can be displaced axially in relation thereto. One end of the penetrator 4 (the lower end in the FIGS.) is open, while the other end thereof is closed by means of an end wall **4*a* having a conical inner edge. This has located centrally thereof an external grip 4*b*, which facilitates dismantling of the arrangement. Placed on the peripheral surface of the end wall 4*a* is an O-ring 4*c*, which is able to slide sealingly against the inner wall surfaces of the outer sleeve 6 as the spotter sleeve and the penetrator pass along the sleeve during a marker firing sequence. Provided in the wall 4*a* are three through-passing apertures 4*d***, the function of which will be described hereinafter.

The spotter sleeve 1, which may be made from a plastics material, is cylindrical in shape and is arranged within the penetrator 4 and axially displaceable relative thereto. The spotter sleeve 1 is open at one end (the bottom end), whereas the other end of the sleeve is closed by means of an end wall **1*a* having a forwardly facing conical edge which, during a firing sequence, lies against the conical inner edge of the wall 4*a***.

Figure 2:
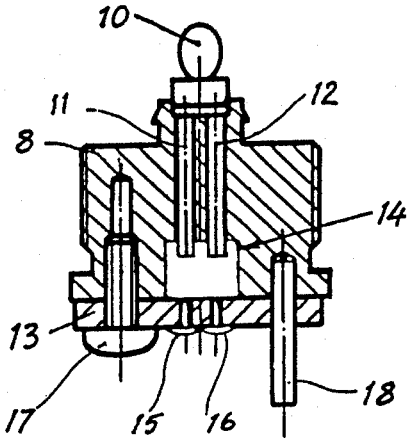
FIG. 2 is a cross-sectional view taken on the line II—II in FIG. 1, illustrating a screw-base forming part of the arrangement.

The spotter charge 5, for example pistol powder or some other suitable powder charge, is accomodated in a container 7 which extends into the spotter sleeve 1 and which is attached, e.g. with the aid of a snap-fastener, to a screw-base 8 (illustrated separately in FIG. 2) screwed firmly into the bottom end of the outer sleeve 6. A draw spring in the form of a coil spring 9 is connected at the upper end thereof to the end wall 1*a* of the spotter sleeve 1, and at the bottom end thereof to the screw-base 8.

Mounted in an upper end surface of the screw-base 8, which may be made of aluminium for example, is a fuse head 10 having connected thereto two electrical conductors 11 and 12, which pass through the screw-base 8 to the other end surface thereof, where they are soldered firmly to a pattern card 13 made of epoxy glass fibre. The conductors 11 and 12 are covered with an electrical insulation, and each conductor passes through a respective lead-through in the screw-base 8.

At the location where the conductors are soldered to the pattern card 13 there is provided in the screw-base a larger cavity 14 through which both conductors are drawn. The lead-through is suitably sealed with the aid of a silicone rubber seal, and to this end the cavity 14 is provided with a rough surface, so that the silicone rubber obtains a firmer grip and therewith provides a better seal. The electrical insulation provided on the conductors may be given a length which ensures that the ends of the insulations are also covered by the silicone rubber, thereby effecting a seal between the insulation and its associated conductor. Two contact sleeves 15 and 16 are soldered firmly to the pattern card 13 and connected to the two electrical conductors 11 and 13 soldered to the fuse head 10, by means of a conductor pattern on the pattern card 13. The pattern card 13 is secured to the screw-base 8 by means of a screw 17 and a tightening pin 18.

The coil spring 9 is varnished and is suitably made of a steel-grade having a low elastic limit. One end of the spring (the upper end in the Figures) is bent to form an eye, through which a screw 19 is passed and screwed into the end wall 1*a* of the spotter sleeve 1, therewith to fasten the spring at said one end. The screw 19 passes through a bush 20 mounted in a bore 21 passing through the end wall 1*a*. Formed in the forward part of the bore 21 is a hexagonal recess which accommodates a nut 22, into which the screw 19 is screwed. Located between the eye in said one end of the spring and the head of the screw 19 is a washer 23 which is given a radius such as to reduce the risk of the spring breaking when stretched.

Figure 3:
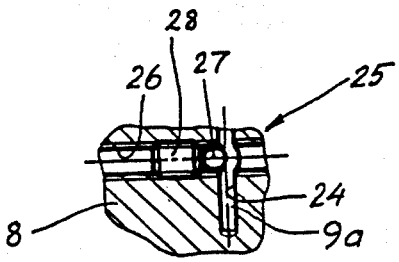
FIG. 3 illustrates the attachment of a spring forming part of the arrangement.

The other end of the spring 9 terminates in a straight portion 9*a* having a length of about 9 mm and extending parallel with the centre axis of the spotter sleeve 1. This straight end portion 9*a* of the spring is anchored in a hole 24 in the screw-base 8 by means of a locking device 25 illustrated in FIG. 3. This device incorporates a bore 26 which crosses the hole 24 and which has arranged therein a ball 27, which can be forced against the spring portion 9*a* with the aid of a screw 28 in a manner to deform said spring portion and therewith secure it against with-drawal through the hole 24.

Figure 5:
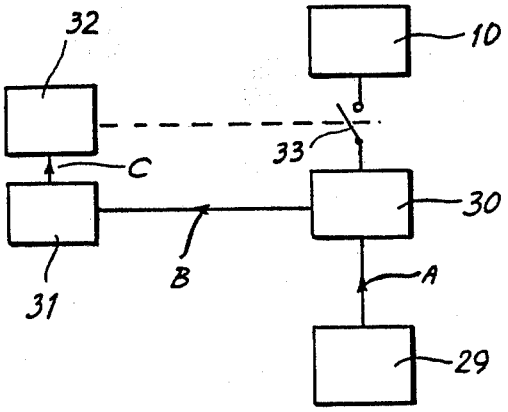
FIG. 5 is a block schematic illustrating the mine components intended for generating an initiating pulse for detonation of the spotter charge.

The fuse head 10 of the spotter charge is detonated in the manner illustrated schematically in FIG. 5.

An electronic timing circuit 29 is arranged to send an electric pulse (indicated by the arrow A) to an initiator in the form of a detonation pulse generator 30 after a pre-set length of time has lapsed, for example 40 days, provided that the mine has not been exploded prior to the expiration of this time period. The generator 30 therewith delivers an electric pulse (indicated by the arrow B) to a force generator 31 (e.g. a motor) which causes (indicated by the arrow C) a detonator rotor 32 to turn from an armed position to a disarmed position. When the rotor 32 is located in its disarmed position, an activator in the form of a switch 33 is activated and closes an electric circuit from the detonating pulse generator 30 to the fuse head 10 of the spotter charge.

The fuse head 10 therewith ignites the powder charge 5, generating a pressure build-up which urges the spotter sleeve and the spring 9 against the inner wall of the penetrator 4, the gas pressure causing the penetrator to fracture the folded edge 5*a* of the outer sleeve 6 and to be shot from the mine, and also through any camouflaging material that may have been placed over the mine. This firing sequence is illustrated in FIG. 4. During a first stage of the firing sequence, movement of the penetrator 4 is accompanied by the spotter sleeve, and since the spring 9 is attached to the spotter sleeve 1 and also to the screw-base 8, which is anchored to the mine via the outer sleeve 6, the spring will begin to extend and stretch, when the penetrator, and therewith also the spotter sleeve, has reached a point at which the gas pressure is relieved, i.e. during a second firing phase, the spring 9 attempts to withdraw the spotter sleeve from the penetrator 4. The spring 9 therewith also functions as a separating means for separating the sleeve 1 from the penetrator 4.

Gas under high pressure also flows through the aforementioned three apertures 4*d* in the end wall 4 and into a space 34 located between the end walls 1*a* and 4*a* (c.f. FIG. 4), thereby to prevent the creation of a partial vacuum in the penetrator as the spotter sleeve is withdrawn therefrom. It will be understood that if the creation of a partial vacuum were to be permitted, the suction force generated thereby would prevent smooth separation of the penetrator from the spotter sleeve and cuase the spring to be torn off. The the pressurized gas flows through the apertures 4*d* there can be obtained a pressure of mutually equal magnitude on both sides of the end wall 4*a*. When the pressure externally of the penetrator subsequently falls rapidly away, the enclosed pressure will assist in ejecting the spotter sleeve from the penetrator.

Upon leaving the ground, the penetrator 4 flies into the air at high speed, while the spotter sleeve 1 and the withdrawn spring 9, the bottom end of which is constantly held anchored to the screw-base 8, fall onto the ground in the close vicinity of the buried mine. The spring remains in its extended shape due to the low elastic limit of the material from which it is made (when a material passes its elastic limit, it is no longer elastic and will not therefore return to its original shape and dimensions).

We claim:

1. An arrangement in a mine which is capable of being neutralized and which is intended for burial in the ground, including detecting means (33) operative to detect a neutralization of the mine, initiator means (30) adapted to initiate detonation of a spotter charge (5) incorporated in the mine in response to the detection of a neutralization, and a spotter (1) which is arranged to be driven by the detonated charge from the mine to the surface of the overlying ground, in order to disclose the location of the mine, characterized in that a penetrator (4), which is intended to drive a pathway through the ground to facilitate passage of the spotter (1), is arranged forwardly of the spotter as seen in its direction of travel, said spotter being capable of driving the penetrator in said direction during a first phase of the spotter firing sequence; and in that the arrangement further includes a separating device (9) which is intended to separate the spotter from the penetrator during a second phase of the firing sequence.

2. An arrangement according to claim 1, characterized in that the separating means comprises a spring (9) which is connected at one end to the spotter (1) and at the other end to the mine (8).

3. An arrangement according to claim 1, characterized by means for providing the gases generated by the spotter charge (5) access to an area (34) located between the penetrator (4) and the spotter (1), such as to cause a gas-pressure build-up in said area, said gas-pressure being effective to assist in the separation of the spotter from the penetrator.

4. An arrangement according to claim 1, characterized in that the penetrator (4) and the spotter (1) are arranged to be ejected together from a cylindrical sleeve (6) arranged in the mine.

* * * * *